United States Patent [19]

Vorbach

[11] 4,214,468

[45] Jul. 29, 1980

[54] HOT ROLLING PILGER MILL

[75] Inventor: Emil Vorbach, Mönchen-Gladbach, Fed. Rep. of Germany

[73] Assignee: Mannesmann Aktiengesellschaft, Düsseldorf, Fed. Rep. of Germany

[21] Appl. No.: 954,829

[22] Filed: Oct. 26, 1978

[30] Foreign Application Priority Data

Oct. 31, 1977 [DE] Fed. Rep. of Germany ..... 2749102

[51] Int. Cl.[2] ..... B21B 1/42

[52] U.S. Cl. ..... 72/189; 72/252

[58] Field of Search ..... 72/189, 252

[56] References Cited

U.S. PATENT DOCUMENTS

| | | | |
|---|---|---|---|
| Re. 13,377 | 3/1912 | Blaxter | 72/252 |
| 3,512,386 | 5/1970 | Teppgard | 72/189 |
| 3,570,294 | 3/1971 | Shibata | 72/189 |

*Primary Examiner*—Lowell A. Larson

*Attorney, Agent, or Firm*—Smyth, Pavitt, Siegemund, Jones & Martella

[57] ABSTRACT

The feeder and the rolls are operated by separate cranks to avoid obstruction of the area in which the hollows are connected to the feeder. The two cranks are either separately driven or connected to a common drive; in either case, synchronism is maintained, and, preferably, an alternating retarding and advance component of movement is superimposed on one crank in relation to the other so that the feeder drive can take up some of the deforming work.

8 Claims, 3 Drawing Figures

HOT ROLLING PILGER MILL

BACKGROUND OF THE INVENTION

The present invention relates to hot pilger rolling, and more particularly, the invention relates to improvements in a hot pilger rolling mill.

A rolling mill of the pilger type is usually comprised of a fixed frame and stand supporting bearing blocks or roll mounts which can be displaced transversely to the direction and axis of rolling. A pair of pilger type rolls are journalled in these blocks or mounts and the rolls caery pinions meshing a gear element in driving engagement, particularly for imparting oscillating movement upon the rolls. The gear elements are being driven from a main drive. A feeder is disposed in the line of rolling and includes a longitudinally movable carriage or slide on which is mounted the mandrel rod holder and other equipment.

In my copending application Ser. No. 886,539, filed Mar. 14, 1978, now U.S. Pat. No. 4,152,917 granted May 8, 1979, I have disclosed two journal gear segments on the bearing blocks or roll mounts. These segments are preferably provided with internal gearing and mesh pinions on the rolls for driving them. A crank mechanism is provided to drive and reciprocate the feeder for the mill; in addition, the segments are coupled to that crank mechanism to be driven thereby to obtain oscillatory movement of the rolls.

DESCRIPTION OF THE INVENTION

It is an object of the present invention to improve rolling mills of the pilger rolling variety which avoids the use of coupler rods between the crank and the immediate roll drive device such as the segments mentioned above.

It is a further object of the present invention to provide a new and improved rolling mill of the type outlined above which permits a controlled distribution of load between roll drive and feeder; for example, the deforming work is to be taken up in parts by the feeder during the initial phase of a piler pass.

In accordance with the preferred embodiment of the invention, it is suggested to provide separate cranks for the feeder and for the rolls and to separately couple the two cranks by means of linkage means including coupler rods, to the feeder and to the rolls respectively. The two cranks are driven in synchronism either by means of a common drive with separate output transmission branches leading to the two cranks, or by means of two drives which are forced to drive in synchronism with each other. In the latter case, it is of advantage to place the feeder drive and the crank on a carriage which is stepwise separately advanced. This way, one reduces the total weight of the parts being reciprocated as part of the feeder operation. One of the two linkage means includes a rocking lever, adjustably connected to and operated by the respective crank or linkage rod. The synchronous movements of th cranks are modified by superimposing a component upon one of them to periodically alter the relation of the movements of the crank as between advance and retarding. This way, some of the rolling work is taken up by the feeder drive.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
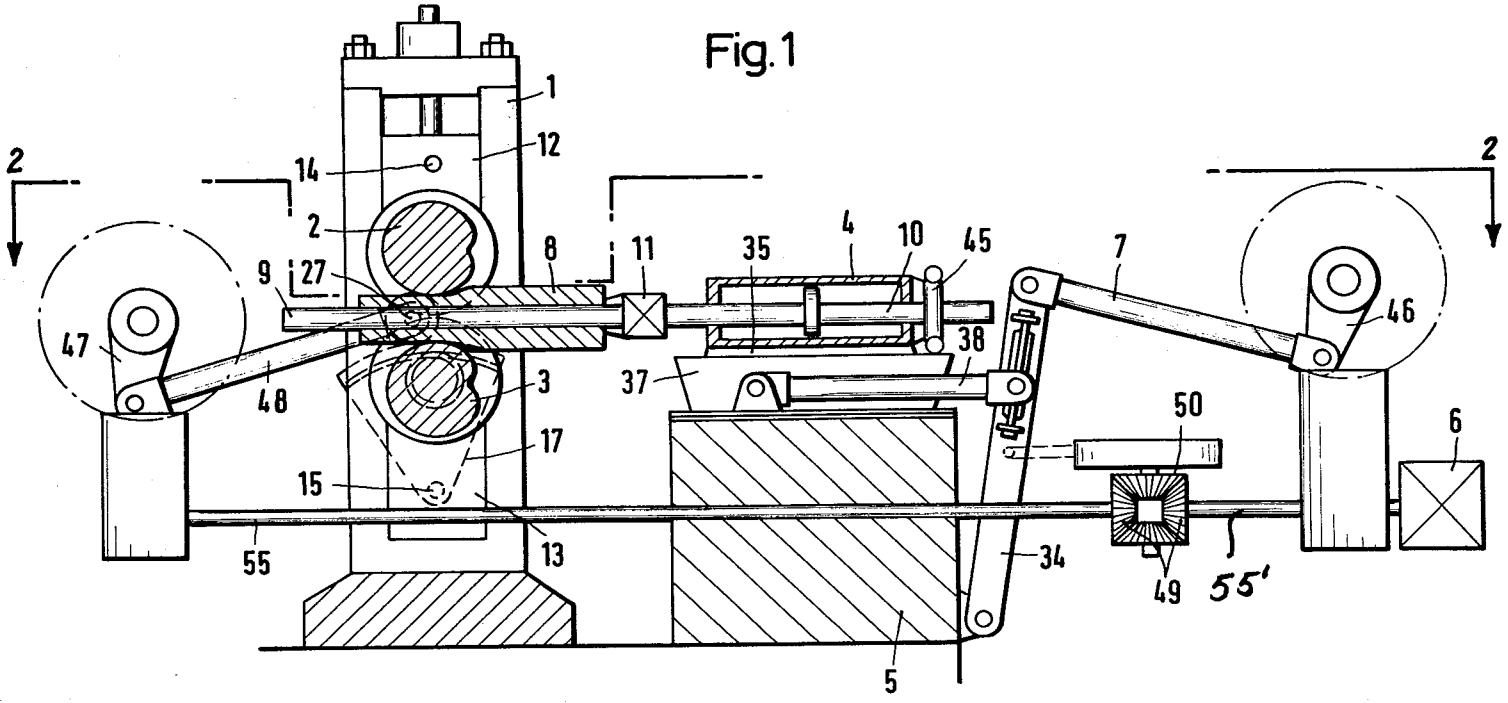
FIG. 1 is a longitudinal cross-section through a pilger rolling mill in accordance with the preferred embodiment of the present invention showing a common drive for feeder and rolls.
Figure 2:
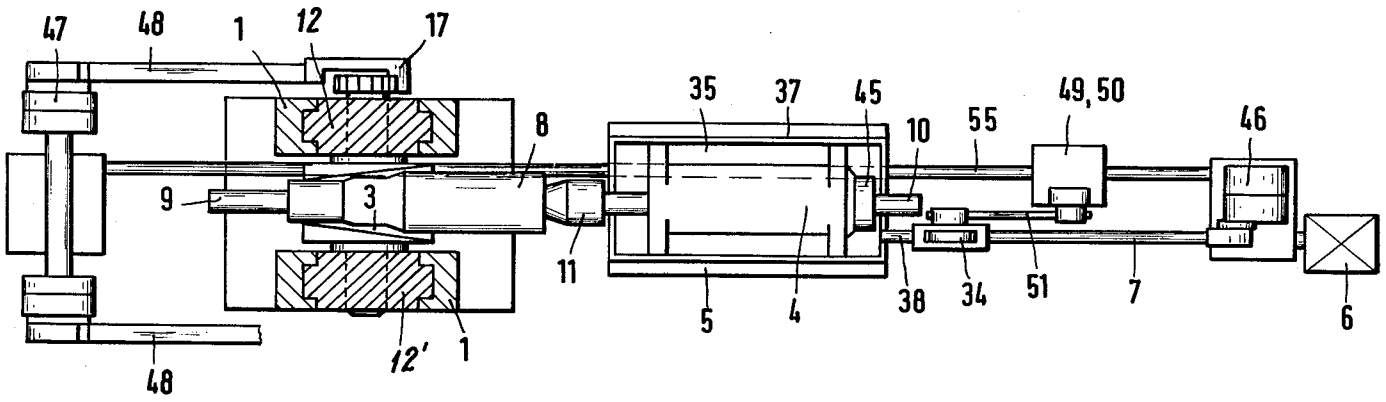
FIG. 2 is a top elevation of the mill shown in FIG. 1, a portion being shown in section view as indicated by lines 2—2 in FIG. 1.

Proceeding now to the detailed description of the drawings, the pilger rolling mill depicted in FIGS. 1 and 2 is comprised of a main stand 1 for pilger type rolls 2 and 3, being journalled for rotation in the stand. The hollow 8 to be rolled is positioned by means of a feeder 4, which is constructed basically as a reciprocating carriage on a stationary bed 5.

The feeder 4 is driven by means of a main drive 6, which drives other components as well. The carriage is driven by drive 6 via a crank 7, to be described in detail below. The hollow blank 8 sits on a cylindrical mandrel rod 9 for placement between the two rolls 2 and 3 to obtain rolling of the hollow by means of reciprocation of the crank driven mandrel rod 9.

The elements as described thus far constitute the major components of the mill. The rolls 2 and 3 are journalled in block inserts or roll mounts whereby roll 2 is journalled in the two inserts 12 and 12', and roll 3 is journalled in insert or roll mount 13, and a second one, behind 13' in FIG. 1, and arranged analogously and in vertical alignment with insert 12'. These inserts are adjustably mounted in the stand to adjust the width of the rolling gap and to exchange worn rolls.

A shaft 15 is journalled also in inserts 13 and 13', carrying a gear segment 17. The segment 17 has an inner gear meshing a pinion on the shaft of roll 3. A similar shaft 14, carrying a similar gear segment (not shown) meshes a pinion on the shaft of upper roll 2. This additional gear segment and pinion is situated in a plane in front of the plane of the drawing of FIG. 1. Further details of the roll stand and the drive segments are shown in my copending application Ser. No. 886,539.

The mandrel rod 9 is connected to a feeder rod 10 by means of a lock 11. The rod 10 advances and retracts with the carriage of the feeder, and is also provided for rotation by means of a rotating drive 45. The carriage of the feeder 4 includes a feed slide 35 which can slide on the movable bed 37, being the base element of the carriage and being provided to move on stationary bed 5. The feeder rod 10 is hydraulically centered in the top part of feed slide 35. The hydraulic centering is described in greater detail in my copending application, Ser. No. 886,539. Centering is also possible by means of springs.

A drive, not illustrated, moves slide 35 on bed 37 to obtain the stepwise advance of hollow 8 between the rolls 2 and 3 for sequential passes. In other words, this additional drive stepwise repositions the hollow as to the onset for each of the sequential pilger passes. The carriage as a whole and bed part 37 in particular, is driven as follows. The crank arm 7 is rotated by a crank 46 which is driven by drive 6. The crank arm 7 is connected to one end of a rocking lever 34 whose other end is, for example, pivoted on the base 5. A drive rod or arm 38 is connected to rocking lever or arm 34 at an adjustable distance from either end of rocking lever 34, and that drive rod 38 is connected to the movable bed 37 to drive same. The adjustable connection between parts 34 and 38 permits adjustment of the linkage to different roll diameters.

The drive 6 is further drivingly connected to a shaft 55 which is connected to a shaft 55' via a planetary type gear 49. The shaft 55, in turn, is geared to another crank 47 operating a pair of crank arms 48 and these crank arms are pivotally linked, respectively, to the two gear segmens 17 by means of pivot linkages such as 27. Thus, the crank arrangement 47, 48 moves the segments 17 back and forth.

The gear 49 has a housing 50 which, when moved, superimposes a relative movement upon shaft 55. A crank arm 51 is connected to a point on rocking lever 34 to thereby drive the gear housing 50. This connection in general and the crank arm 51 in particular provide for a change in relative speed between the feeder and the rolls. In particular, the modification of the roll speeds as so introduced permits the rolls and feed drives to periodically alternate between advance and retarding of one relative to the other. Particularly, during a rolling pass, the feeder may advance to thereby cause the feeder drive (crank 46, 7, etc.) to take up some of the deforming work. Towards the end of the rolling pass, during sizing, the feeder may be retarded so that part of the braking can be used to drive the rolls. It should be realized that the planetary gear by means of which one superimposes a relative component of movement as between the two cranks, could be placed into the drive train that leads to the crank 46, 7, and the superimposed component is taken from the other crank and/or the linkage thereof to the rolls.

The arm 51 is chosen as being linked in a fixed point on arm 34, but just as rod 38 is adjustably linked to arm 34, so can crank arm 51. It should also be realized that the drive point for the crank 51 can be taken from other portions of the crank feeder drive train 46, 7, 34, 38. Still alternatively, one could use a piston drive for the housing 50.

Figure 3:
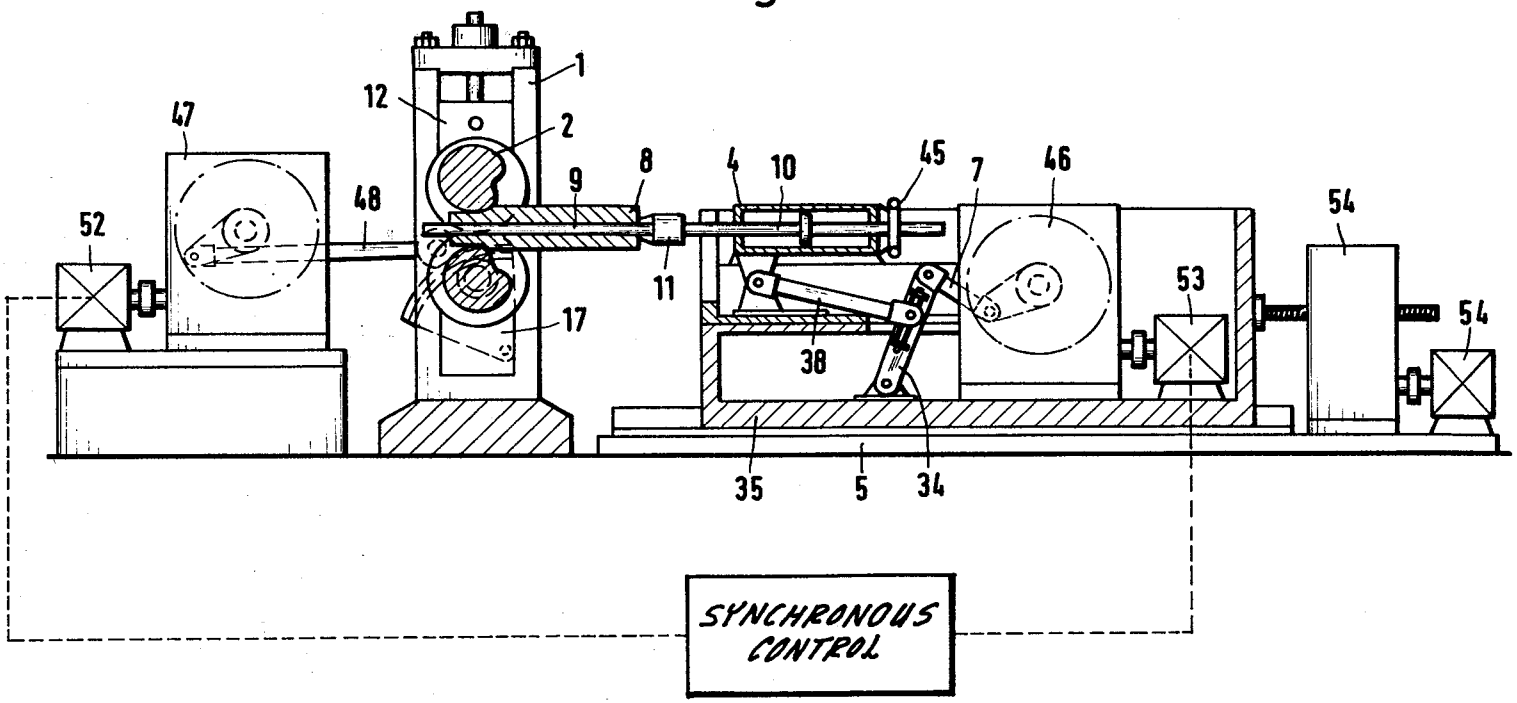
FIG. 3 is a view similar to FIG. 1, but showing separate drive motors for feeder and rolls.

FIG. 3 illustrates a modification of the mill as shown in FIGS. 1 and 2, but many parts and components are similar. This similarity involves particularly the provision of the two cranks 46, 47, and the parts being driven by them, i.e. the rolls and the feeder. Different is that the two cranks 46, 47 are driven by separate drives each having its own drive motor, respectively, denoted 53 and 52.

The drive 53 for crank 46 and the parts driven by it are all disposed on slide 35. Slide 35 is moved on bed 5 in steps of the rolling passes and by means of a drive 54 with reducing gear 54'. Thus, the relationship is reversed in this case as far as feeder positioning and feeder reciprocating is concerned. Nevertheless, the masses being moved in this example are lower than in the device of FIGS. 1 and 2.

The motor 52 just drives the crank 47 and the crank arms 48, being coupled to the roll drive segment gears as described. The motors 52 and 53 may well be mechanically coupled to each other because the linear output speeds involved are low in both instances. For example, one could provide a coupling shaft constructed as a splined shaft between the motors to enforce a synchronous run. However, it is simpler to control the drive motors 52 and 53 electrically to obtain synchronous operation. It is important that upon stopping, the cranks 46, 47 must retain their position. For this, it is, for example, suggested to use shoe brakes. The advance of the reciprocating feeder 4 relative to rolls 2 and 3 during a rolling pass proper can also be realized electrically, whereby a control pulse is derived through a suitable transducer either from the carriage 4 or from one of the rolls 2, 3 to control the drive for the respective other one.

It can readily be seen that in both examples the space between and adjoining feeder 4 and roll stand 1 is unoccupied so that the feeding of hollow stock and withdrawal of the rolled hollow is unimpeded by linkage. The shaft 55 can be regarded as a coupling element as between the cranks, but it can be well hidden under the floor of the plant. Moreover, the dynamic coupling of the cranks and alternating between retarding and advance phase during a pass, particularly upon relatively advancing the carriage in relation to the rolls 2 and 3, the drive 46, 53 can actually take up part of the deforming work.

The invention is not limited to the embodiments described above but all changes and modifications thereof not constituting departures from the spirit and scope of the invention are intended to be included.

We claim:

1. In a hot pilger rolling mill, having a pair of grooved, contoured pilger rolls and means coupled to the rolls for transmitting motion upon them, further having a feeder with a carriage and a mandrel rod holding the hollow to be rolled, the improvement comprising:

a first crank;

first linkage means, including rod means connecting the first crank to the means for transmitting motion to thereby drive the pilger rolls;

a second crank;

second linkage means, including rod means connecting the second crank to the feeder carriage to reciprocate the carriage during rolling;

means connected for driving the first and second cranks in synchronism to each other; and means operatively connected for alternately superposing a relative, retarding component of movement and a relatively advancing component of movement between the rolls and the feeder to relieve the rolls by, relatively, advancing the feeder during a rolling pass and by retarding it towards the end of the pass.

2. The improvement as in claim 1, one of the linkage means including a rocking lever to which the respective rod means is adjustably connected.

3. The improvement as in claim 1, said means for driving including a common drive and separate drive branches connected to said cranks.

4. The improvement as in claim 1, 2, or 5, said means for superimposing a retarding and an advancing movement component acting upon one of the linkage means.

5. The improvement as in claim 1, said means for superimposing including a planetary gear having an output leading to one of said cranks and means connecting the planetary gear additionally to the respective other linkage means do drive therefrom said components.

6. The improvement as in claim 1, wherein said drive means includes first and second drive motors, respectively connected to said first and second cranks, said motion being superimposed upon control of one of the motors.

7. The improvement as in claim 1, including a base; first slide means on the base; second slide means on the first slide means and including means for holding said mandrel rod; said second crank being connected to one of the slide means; and additional drive means connected to drive the respective other slide means.

8. The improvement as in claim 7, said second crank being on said first slide means to drive said second slide means, said drive means including first and second drives connected respectively for driving the first and second cranks, the second drive being also on the first slide means.

* * * * *